US007682104B2

(12) United States Patent
Wassman et al.

(10) Patent No.: US 7,682,104 B2
(45) Date of Patent: Mar. 23, 2010

(54) CULVERT INLET PROTECTION DEVICE

(75) Inventors: Matthew A. Wassman, Hudson, WI (US); Julian P. Trangsrud, Northfield, MN (US); Richard M. Odland, Chisago City, MN (US)

(73) Assignee: Royal Concrete Pipe, Inc., Stacy, MN (US)

( * ) Notice: Subject to any disclaimer, the term of this patent is extended or adjusted under 35 U.S.C. 154(b) by 569 days.

(21) Appl. No.: 11/616,722

(22) Filed: Dec. 27, 2006

(65) Prior Publication Data

US 2007/0154266 A1 Jul. 5, 2007

(51) Int. Cl.
*E03F 5/14* (2006.01)

(52) U.S. Cl. ..... 405/125; 404/2; 210/166; 210/170.03

(58) Field of Classification Search ..... 210/163, 210/164, 166, 170.01, 170.03; 404/2; 405/125
See application file for complete search history.

(56) References Cited

U.S. PATENT DOCUMENTS 894,339 A * 7/1908 Niemeier ..... 405/127
1,245,903 A * 11/1917 Gross ..... 210/163
3,587,239 A * 6/1971 Feland et al. ..... 405/125
5,037,542 A * 8/1991 Carroll ..... 210/161
5,403,474 A * 4/1995 Emery ..... 210/163
5,843,306 A * 12/1998 Singleton ..... 210/163
6,306,293 B1 * 10/2001 Schilling et al. ..... 210/164
6,338,595 B1 * 1/2002 Schollen ..... 405/125
6,609,852 B2 * 8/2003 Wimberger ..... 405/40
7,396,471 B2 * 7/2008 Wimberger ..... 210/747

* cited by examiner

*Primary Examiner*—Tara Mayo-Pinnock
(74) *Attorney, Agent, or Firm*—C. G. Mersereau; Nikolai & Mersereau, P.A.

(57) ABSTRACT

A temporary culvert barrier for placing across the mouth of a culvert for blocking litter and debris from entering or exiting the culvert and for filters to block silt or sand from clogging the culvert or the drain area. The filters may also be selected to absorb oils salts or other chemicals. The temporary barrier is easy to install and remove. The barrier plates and filters fit to the size of the culvert mouth and have adjustment slots for different width mouths. The culvert barrier may be used to prevent pollution at construction sites and be temporarily or permanently attached to culvert mouths. The filters may be changed or cleaned as required.

19 Claims, 4 Drawing Sheets

CULVERT INLET PROTECTION DEVICE

BACKGROUND OF THE INVENTION

1. Field of the Invention

This invention relates to pollution control devices for removing litter, sediments, salts and chemicals from water flowing through culverts and for preventing clogging of culverts.

2. Description of the Related Art

It has been the practice to place bales of hay or stones around the mouth of a culvert to slow down water flows and act as a barrier for litter and sediment. This method requires a substantial area around the mouth of the culvert and depending on the placement of the stones or hay, may not block all of the flow of water so as to not stop all litter or sediment from flowing past the barrier. Further, over time the barrier may shift, causing flows of water to carry litter and sediment past the barrier and into the culvert. Further, oils, salts or chemicals detrimental to the environment may be able to flow through the culvert and escape into the environment.

Another method of preventing litter and sediment from flowing from culverts has been to place a geotextile on poles stuck in the ground some distance in front of the culvert opening to block the water flow. However, water tends to flow around or under such barriers and is not an effective way to prevent litter and sediment from clogging the culvert or escaping into the environment.

During construction or at other times when debris, chemicals or oils may be likely to be washed through a culvert the temporary barriers may be used to prevent debris and silt from clogging the culvert or polluting the area around the culvert. Filters for oils, salts or chemicals may be temporarily needed on some culverts.

SUMMARY OF THE INVENTION

The culvert inlet protection device has barrier plates with apertures for allowing water to flow therethrough while preventing debris from passing. The barrier plates are placed across and attached to the mouth of the culvert thus taking up a small area at the end of the culvert and effectively blocking all the water passing through the culvert. A filter can be placed between the barrier plates to screen out sediment. The filter material can be selected to screen for salts, oils or other chemicals. The barrier plates can be quickly and easily attached to apertures in the culvert by bolts and just as easily removed when no longer needed. The barrier plates need not cover the entire opening of the culvert. The barrier plates preferably cover about ⅔ of the opening from the bottom toward the top of the culver mouth. In this manner, an overflow area is left at the top of the face of the culvert. The culvert opening may also have a plurality of bars across the opening so that animals or objects cannot enter the culvert. Such bars may be used as a safety precaution so that people or vehicles do not fall into the culvert opening.

OBJECTS OF THE INVENTION

It is an object of the invention to provide a temporary barrier for silts and debris from clogging culverts due to rain.

It is an object of the invention to provide a temporary barrier for oils, salts, or chemicals from entering culverts and polluting the environment downstream.

It is an object of the invention to quickly and easily install and remove the temporary barriers.

It is an object of the invention to provide a temporary barrier for silts and debris from clogging drain areas due to runoff.

It is an object of the invention to provide filters for removing pollutants from runoff water in a culvert.

It is an object of the invention to provide barriers for any size culvert.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
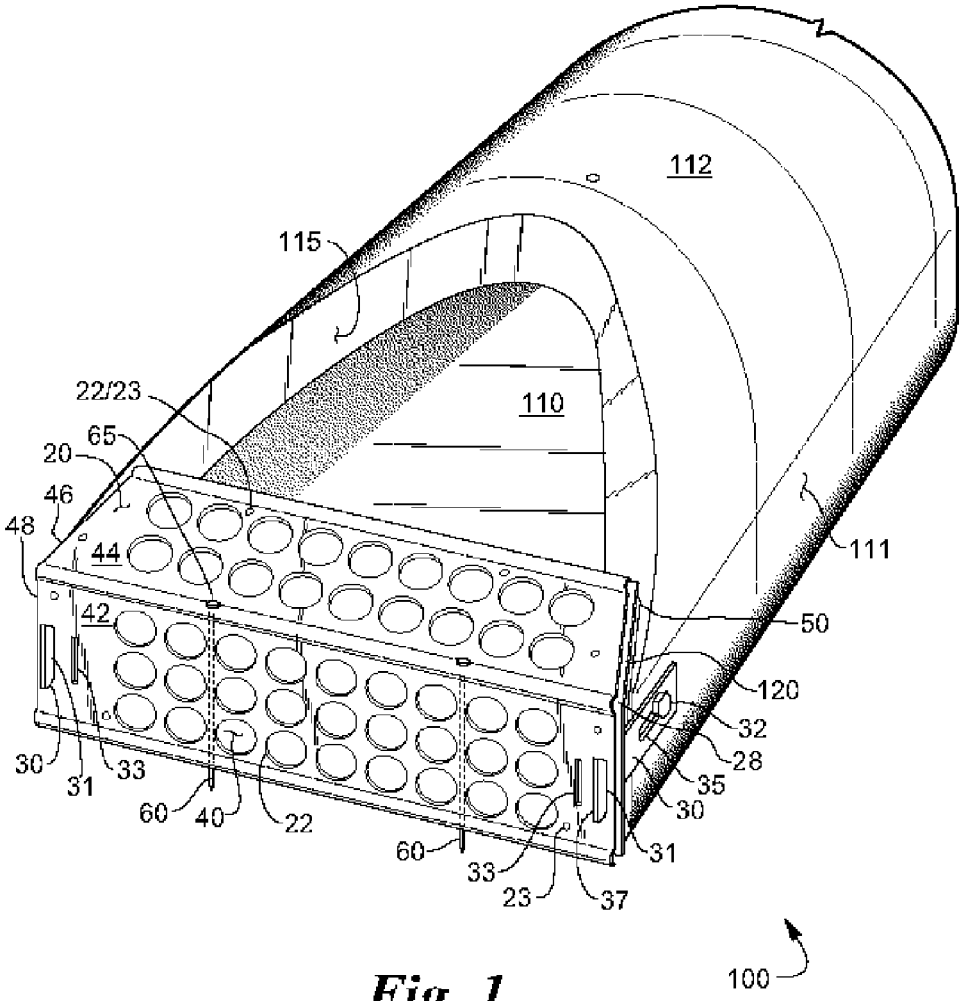
FIG. 1 is a perspective view of a culvert with a sheet of barrier material and a filter across the front.
Figure 2:
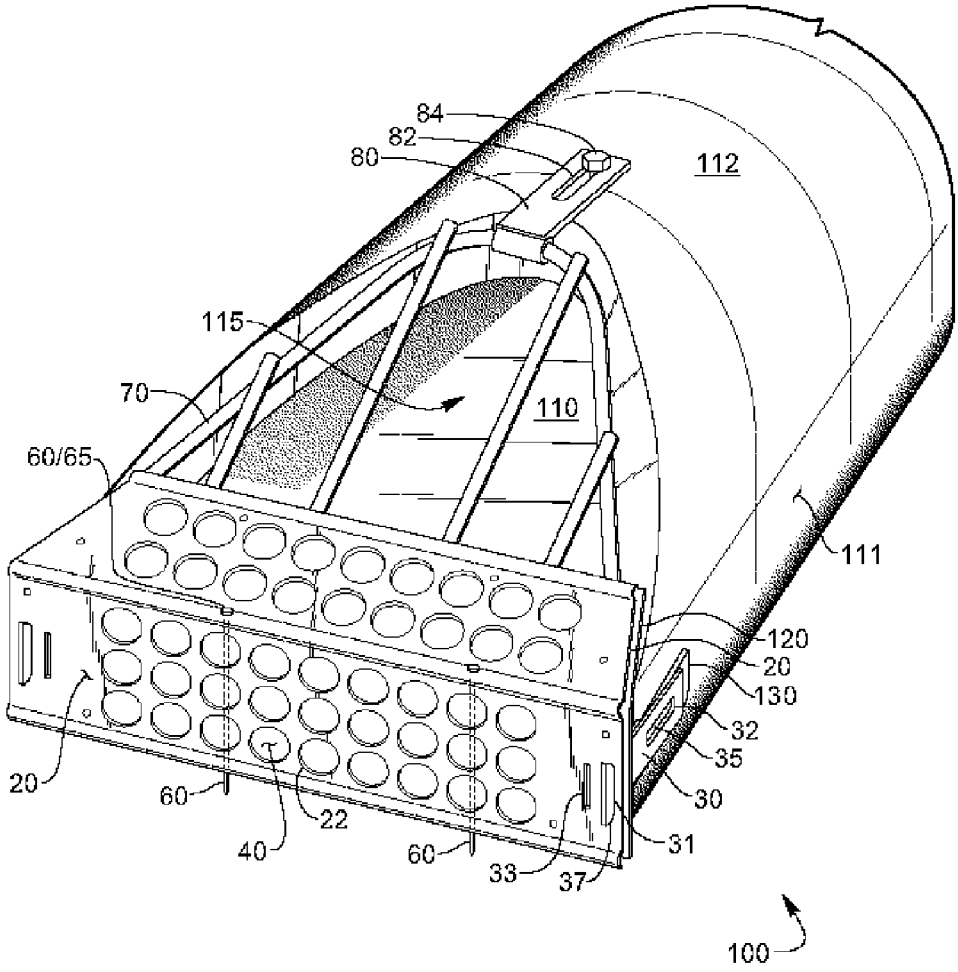
FIG. 2 is a perspective view of a culvert with a sheet of barrier material and a filter across the front of the culvert, stakes supporting the barrier material and bars covering the barrier material and the culvert opening.

A culvert 100 with a typical shape and opening is shown in the figures. The culvert 100 shown has a flat bottom base 110 with upstanding walls 111 at each side of the base and a curved dome portion 112 covering the culvert. The mouth 115 is cut at an angle though the dome 112 and straight up and down at the walls 111 and has a flat bottom base 110. The culvert may be made out of almost any material, such as concrete, plastic, metal or fiberglass. The culvert 100 may have any cross-sectional shape, but typically has an angled cut open top portion to the mouth.

In FIG. 1 the culvert 100 has mouth 115 partly covered by a barrier comprising barrier plates 20, 120 which are made from a sheet of material having a plurality of apertures 22. The barrier plates 20, 120 are riveted together by rivets 23 and have a filter material 40 sandwiched therebetween. The barrier plates 20, 120 are attached to the mouth 115 of the culvert 100 so that it covers on the order of ⅔ of the height of the mouth, thus leaving the top portion open for overflow of water during heavy rains. The barrier plates 20, 120 can be used to restrict the flow into the culvert 100. There are several options for attaching the barrier plates 20, 120 to the culvert. The barrier plates 20, 120 may be directly attached to the culvert 100. As shown in the figures the barrier plates 20, 120 have apertures 31 and 33 and T-bar 30 passes though a selected aperture 31 or 33 depending on the width of the culvert. The T-bar 30 is attached to the side of culvert 100 preferably using a bolt 32 in a culvert aperture used for lifting the culvert 100 or for some other purpose already preexisting in the culvert so that no drilling is required to install the T-bar 30. The T-bar 30 has a slot 35 for adjusting the position of the T-bar along the side of the culvert 100 and to adjust the position of the barrier plates 20, 120 on the face of the culvert. The T-bar 30 has a head portion 37 which will not fit through aperture 31 or 33 and will pull the barrier plates 20, 120 back against the face of the culvert 100. Ideally the barrier plate 120 runs along the front portion of the culvert 100 covering the front of the base 110, and the front portion of the walls 111. With the barrier plates 20, 120 in place, litter and debris larger than the apertures 22 will not be able to enter the culvert.

In one embodiment the barrier can be a single sheet of material with apertures. Alternatively the single sheet of material may have a filter attached to block the apertures.

In another embodiment, as shown, two barrier plates 20, 120 can be used to sandwich a filter material 40 therebetween. The filter material 40 can be changed by separating the barrier plate 20 from barrier plate 120 and removing the filter 40, then cleaning the filter 40 or inserting a new filter before reattaching the barrier plate 20 to barrier plate 120. In the embodiment shown the barrier plates 20 and 120 are riveted together by rivets 23 but any means for attaching the barrier plates may be used. The filters 40 can be made of any of a variety of materials and used for different purposes. For example geotextiles may be used as the filters. Filters of different weaves may block different grades of sand. Filters of different materials may be used to absorb oil, or different chemicals. Other filters may be used to block salts or other substances.

In order to reinforce the positioning of the barrier plates 20, 120 when assembled, rods 60 may be driven into the ground adjacent the culvert mouth 115 and engage the top of the barrier plate 20 such as through rod apertures 65.

A seal 50 may be used to prevent water from escaping round the edges of the barrier plate 120. Alternatively, caulking, gaskets or other means for preventing leaks may be used.

As shown bracket 30 may have an adjustment slot 35 for adjustably attaching the barrier plates 20, 120 to the culvert 100. A trash guard 70 may be used to cover the mouth 115 of the culvert and barrier plates 20, 120 can rest against or be supported by the trash guard 70. The trash guard 70 may be attached to the culvert 100 at the top of the dome portion 112 by bracket 80 having an adjustment slot 82 and a bolt 84, which is used in an existing aperture of the culvert such that no holes need be drilled in the culvert 100 to attach the trash guard 70. As shown the trash guard 70 fits onto a bracket 130 attached to culvert 100.

Figure 3:
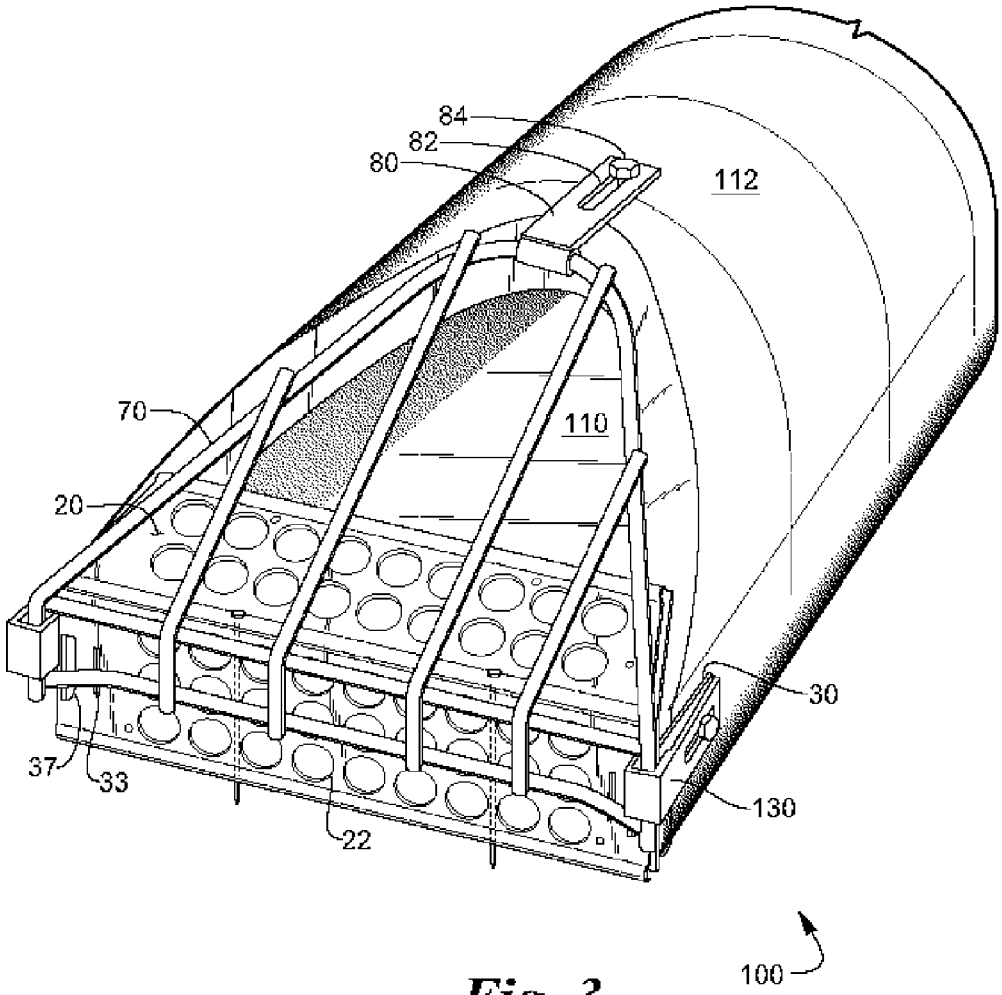
FIG. 3 is a perspective view of a culvert with a sheet of barrier material and a filter across the front of the culvert and bars covering the culvert opening and barrier material.

In FIG. 3 the trash guard 70 is placed over the top of the barrier plates 20, 120.

The barrier material may be made out of plastic, metal or any other material. It is preferred to have the barrier material made out of a material, which can be cut to the size of the culvert mouth 115.

Although the filter fabric 40 is shown sandwiched between two barrier plates 20, 120 it could be attached to the inside or the outside of one barrier plate on the face or back, and glued or otherwise affixed thereto covering the area between the apertures 22.

The number and size of the apertures 22 in the barrier plates 20, 120 may be varied depending on the performance parameters of the culvert barrier and filter. The apertures 22 on the two barrier plates should overlap so that water may flow through the apertures.

Figure 4:
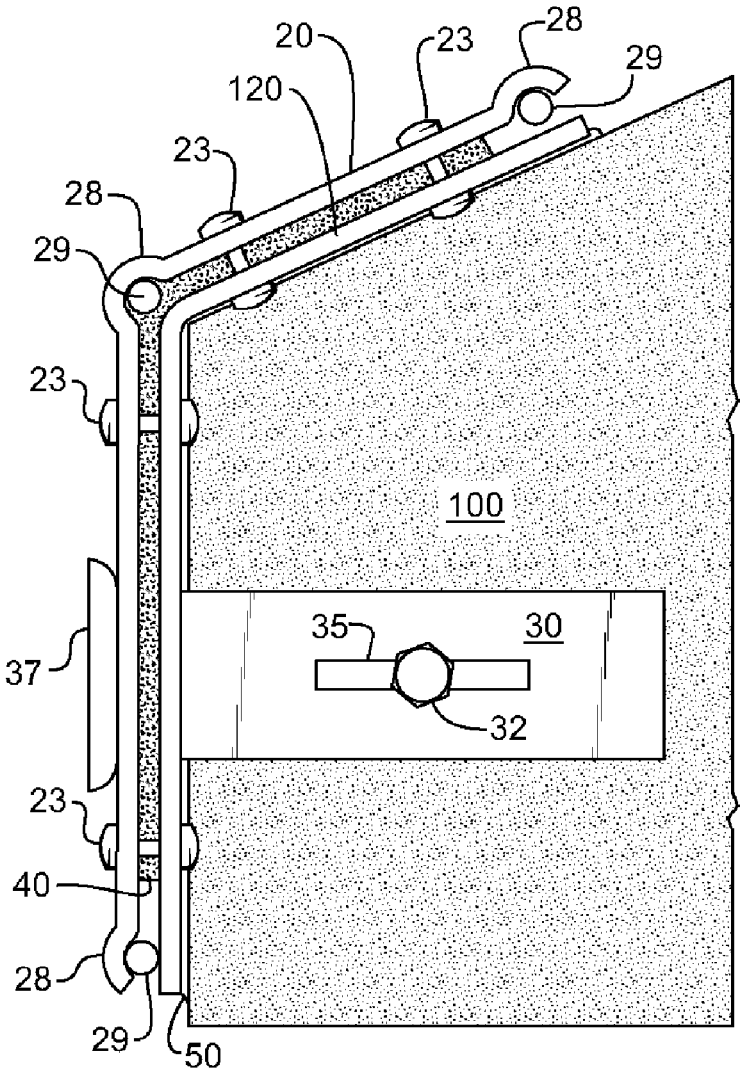
FIG. 4 is a side view of the barrier plates attached to the culvert.

Barrier plates 20, as shown in FIG. 4 may have troughs 28 to strengthen the plates. The troughs may also be used to surround reinforcing rods 29 placed between the barrier plates 20, 120 to increase the strength of the barrier in front of the culvert. Optionally the rods may be attached to the culvert at the ends of the barrier plates.

The barrier plates 20, 120 have a front portion 42 and a top portion 44 angled backward from the vertical front portion 42. The edges 48 on the sides of the front portion 42 are vertical and the edges 46 of the top portion 44 are tapered to match the taper of the culvert mouth 115.

In the field a contractor can select the size of the barrier plates 20, 120 to fit the size of the culvert mouth 115 and then attach the associated T-bar 30 through the appropriate aperture 31 or 33 in the barrier plates 20, 120, and bolt the T-bar to the culvert 100. The face of the barrier plates can then be moved adjacent to the face of the culvert by use of slots 35 to seal the barrier plate 120 to the face of the culvert with seal 50. The head 37 of the T-bar will urge the barrier plate 20 back toward the culvert 100. If rods 60 are needed to reinforce the barrier plates 20, 120 the rods 60 can be inserted and pounded into the ground at the face of the culvert mouth 115 and be attached to the barrier 20, 120 as required. When the culvert protector is no longer needed the barrier plates 20, 120 can be quickly and easily be removed.

What is claimed is:

1. A culvert mouth filter assembly comprising, a barrier plate shaped to fit the contour of the culvert mouth, the barrier plate having a generally vertical front portion and an angled back top portion, the barrier plate having apertures therein for allowing water to pass therethrough, the barrier plate covering a portion of the culvert's mouth from the base upward and leaving a potion of the culvert mouth open for overflow to enter the culvert, a filter material covering the apertures of the barrier plate, a bracket to attach the barrier plate to the culvert in a readily removable manner.

2. A culvert mouth filter assembly as in claim 1 having, a seal between the culvert mouth and the barrier plate to prevent leakage into the culvert.

3. A culvert mouth filter assembly as in claim 1 having, at least one horizontal trough in the barrier plate for added strength.

4. A culvert mouth filter assembly as in claim 3 having, a reinforcing rod in at least one trough for added strength.

5. A culvert mouth filter assembly as in claim 4 having, a rod placed in front of the mouth of the culvert for supporting the barrier plate and holding it in place.

6. A culvert mouth filter assembly as in claim 4 having, a second barrier plate having apertures positioned as in the barrier plate for allowing fluids through the apertures and wherein said rods are sandwiched in the troughs between the plates.

7. A culvert mouth filter assembly as in claim 6 having, a plurality of spaced generally horizontal troughs containing reinforcing rods.

8. A culvert mouth filter assembly as in claim 7 having, a rod placed in front of the mouth of the culvert for supporting the barrier plate and holding it in place.

9. A culvert mouth filter assembly as in claim 7 having, a seal between the culvert mouth and the second barrier plate to prevent leakage.

10. A culvert mouth filter assembly as in claim 7 wherein said troughs are located in said generally vertical front portion, angled back top portion and therebetween.

11. A culvert mouth filter assembly as in claim 6 having, a seal between the culvert mouth and the second barrier plate and the housing to prevent leakage.

12. A culvert mouth filter assembly as in claim 4 having, a seal between the culvert mouth and the barrier plate and the housing to prevent leakage.

13. A culvert mouth filter assembly as in claim 1 having, a rod placed in front of the mouth of the culvert for engaging and supporting the barrier plate and holding it in place.

14. A culvert mouth filter assembly as in claim 13 having, a seal between the culvert mouth and the barrier plate and the housing to prevent leakage.

15. A culvert mouth filter assembly as in claim 1 having, a second barrier plate having apertures positioned as in the barrier plate for allowing fluids through the apertures and sandwiching the filter between the plates.

16. A culvert mouth filter assembly as in claim 15 having, a seal between the culvert mouth and the second barrier plate and the housing to prevent leakage.

17. A culvert mouth filter assembly as in claim 1 having, a trash guard attached to the culvert by brackets, the trash guard extending across the mouth of the culvert.

18. A culvert mouth filter assembly as in claim 1 wherein said bracket is adjustable along said culvert mouth.

19. A culvert mouth filter assembly as in claim 1 wherein said bracket is slip-fit through said barrier plate.

* * * * *